United States Patent [19]

Sato

[11] Patent Number: 4,475,874

[45] Date of Patent: Oct. 9, 1984

[54] SCROLL FLUID APPARATUS WITH AXIAL SEALING FORCE

[75] Inventor: Eiji Sato, Ibaraki, Japan

[73] Assignee: Hitachi, Ltd., Tokyo, Japan

[21] Appl. No.: 139,548

[22] Filed: Apr. 11, 1980

Related U.S. Application Data

[63] Continuation of Ser. No. 887,252, Mar. 16, 1978, abandoned.

[30] Foreign Application Priority Data

Mar. 20, 1977 [JP] Japan ..... 52-3339

[51] Int. Cl.[3] ..... F04C 1/02

[52] U.S. Cl. ..... 418/55; 418/57

[58] Field of Search ..... 418/55, 57, 131

[56] References Cited

U.S. PATENT DOCUMENTS

| | | | |
|---|---|---|---|
| 3,600,114 | 8/1971 | Dvorak | 418/55 |
| 3,884,599 | 5/1975 | Young et al. | 418/55 |
| 3,924,977 | 12/1975 | McCullough | 418/55 |
| 3,994,633 | 11/1976 | Shaffer | 418/55 X |
| 3,994,636 | 11/1976 | McCullough | 418/55 |

*Primary Examiner*—Leonard E. Smith

*Attorney, Agent, or Firm*—Antonelli, Terry & Wands

[57] ABSTRACT

In a scroll fluid apparatus, a gas of an intermediate pressure level is drawn from the operating chambers in the process of compressing a fluid or expanding the same and applied to the entire area of the back of one of a pair of scroll members so as to force one scroll member tightly against the other scroll member whereby an axial seal can be provided to the pair of scroll members.

6 Claims, 6 Drawing Figures

SCROLL FLUID APPARATUS WITH AXIAL SEALING FORCE

This application is a continuation of U.S. application Ser. No. 887,252, filed Mar. 16, 1978, now abandoned.

LIST OF PRIOR ART REFERENCES [37 CFR 1.56(a)]

The following references are cited to show the state of the art:

U.S. Pat. No. 3,884,599 (Niels O. Young et al)
U.S. Pat. No. 3,994,633 (Robert W. Shaffer)
U.S. Pat. No. 3,994,636 (John E. McCyllough et al)
U.S. Pat. No. 3,924,977 (John E. McCyllough et al).

BACKGROUND OF THE INVENTION

1. Field of the Invention

This invention relates to a scroll fluid apparatus which can serve as a compressor for increasing the pressure of air or other gases, a refrigerant compressor adapted for use with freezing apparatus, showcases or refrigerating apparatus, a refrigerant compressor adapted for use with air conditioning systems or room cooling apparatus, or an expansion device adapted for enabling the Rankine cycle to take place or expanding high pressure gas to a predetermined pressure level to obtain power therefrom.

2. Description of the Prior Art

U.S. Pat. Nos. 3,884,599 and 3,924,977 disclose means for providing an axial seal to a pair of scroll members by maintaining the forward end of the wrap of one scroll member in contact with the end plate of the other scroll member to prevent the leakage of gas from between the two scroll members.

In the means disclosed in these documents, the gas drawn from the discharge region defined by the two scroll members is applied to the back (the surface opposite to the surface from which the wrap extends) of one scroll member so as to force one scroll member tightly against the other scroll member. The gas applied to the back of the scroll member is directed to a portion of the back which is very small in area. In the structural arrangement shown in these documents, a thrust corresponding in amount to the axially displacing force exerted by the gas is brought to bear upon a bearing 47 (See FIGS. 8 and 34 of U.S. Pat. No. 3,884,599) and main shaft bearings 122, 293 and 343 (See FIGS. 8, 34 and 38 of the same specification), so that a heavy thrust load is applied to each of these bearings.

U.S. Pat. Nos. 3,994,633 and 3,994,636 disclose scroll members enclosed by a housing having a housing chamber into which a fluid is introduced from a pressure source located outside the scroll fluid apparatus, so that the fluid can be applied to the back (the surface opposite to the surface from which the wrap extends) of one scroll member to thereby force the same tightly against the other scroll member. The aformentioned arrangement enables the thrust load applied to each bearing to be eliminated. However, some disadvantages are associated with this type of scroll fluid apparatus. One of them is that a separate pressure source must be provided outside the apparatus. Another disadvantage is that, if the scroll fluid apparatus is used as a refrigerant compressor which requires strict caution to be exercised to avoid incorporation of a non-condensing gas in the refrigerant, means must be provided to ensure that the two scroll members are hermetically sealed to prevent the gas introduced into the housing chamber from being incorporated into the gas to be compressed by the scroll members.

SUMMARY OF THE INVENTION

An object of this invention is to provide a scroll fluid appartus which can achieve good axial sealing of its scroll members.

Another object of the present invention is to provide a scroll fluid apparatus which can achieve good axial sealing of its scroll members by means of a simple structural arrangement.

Another object of the invention is to provide a scroll fluid apparatus which does not require a pressure source located outside the apparatus for providing an axial seal to the scroll members of the apparatus.

Still another object of the invention is to provide a scroll fluid apparatus in which the need to provide means for avoiding incorporation of a gas used for effecting axial sealing in a gas to be compressed by the scroll members is eliminated.

To accomplish the aforesaid objects, the invention contemplates the introduction of a portion of a gas at an intermediate pressure stage of a scroll fluid apparatus into a housing chamber formed in a housing connected to a stationary scroll member, so that such gas will provide a force acting on a revolving scroll member to force the same tightly against the stationary scroll member. The gas at the intermediate pressure stage may be drawn into the housing chamber through at least one small aperture formed in the end plate of one of the two scroll members.

DESCRIPTION OF THE PREFERRED EMBODIMENT

Figure 1A:
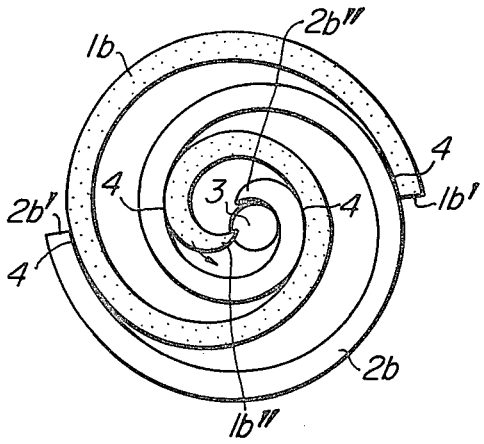
FIGS. 1*a* to 1*d* are views in explanation of the principle of operation of a scroll compressor.
Figure 1B:
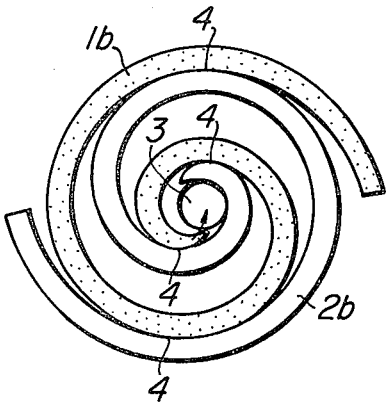
Figure 1C:
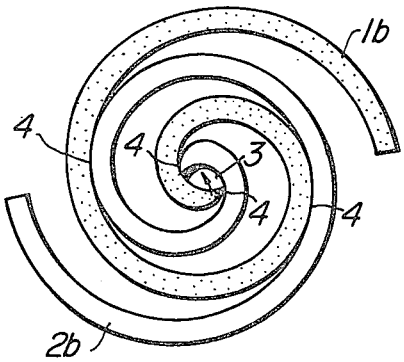
Figure 1D:
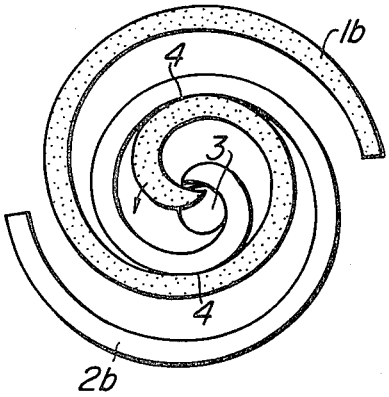

Before describing in detail a preferred embodiment of the invention, the principle of operation of a scroll fluid apparatus will be briefly described with reference to a compressor as a typical example of the scroll fluid apparatus by referring to FIGS. 1*a* to 1*d*. In these figures, the end plates are omitted and the wraps are only shown. FIG. 1*a* shows the relative positions of the wrap 1*b* of a revolving scroll member 1 and the wrap 2*b* of a stationary scroll member 2 as the scroll compressor starts compressing of a fluid upon completion of suction of the fluid. FIGS. 1*b*, 1*c* and 1*d* show the relative positions of the wrap 1*b* and 2*b* after the revolving scroll 1 has revolved counterclockwise through 90 degrees from the positions shown in FIGS. 1*a*, 1*b* and 1*c* respectively.

As the scroll compressor proceeds from the state shown in FIG. 1*a* to the states shown in FIGS. 1*b* and 1*c*, sealed spaces formed by the wrap 1*b* and 2*b* of the two scroll members 1 and 2 respectively are progressively reduced in size and the fluid therein is compressed. The compressed fluid is discharged from the sealed spaces through an outlet port as communication is established between them when the two scroll members 1 and 2 are disposed in certain angular relationship to each other between the positions shown in FIGS. 1*c* and 1*d*. With the revolving scroll member 1 revolving counterclockwise through 90 degrees from the position shown in FIG. 1*d*, the two scroll members 1 and 2 are restored to their original relative positions shown in FIG. 1*a*. In FIGS. 1*a* to 1*d*, the sealed spaces are formed by radial contact lines 4 of the two scroll members 1 and 2. The formation of the sealed spaces will herein be referred to as being effected by radial sealing.

The aforesaid description refers to a compressor. However, it will be understood that if a high pressure gas is supplied to the sealed spaces through the outlet port 3, the revolving scroll member 1 will revolve in a direction opposite to the direction of its revolution described with reference to the compressor and the apparatus will function as an expansion device.

Figure 2:
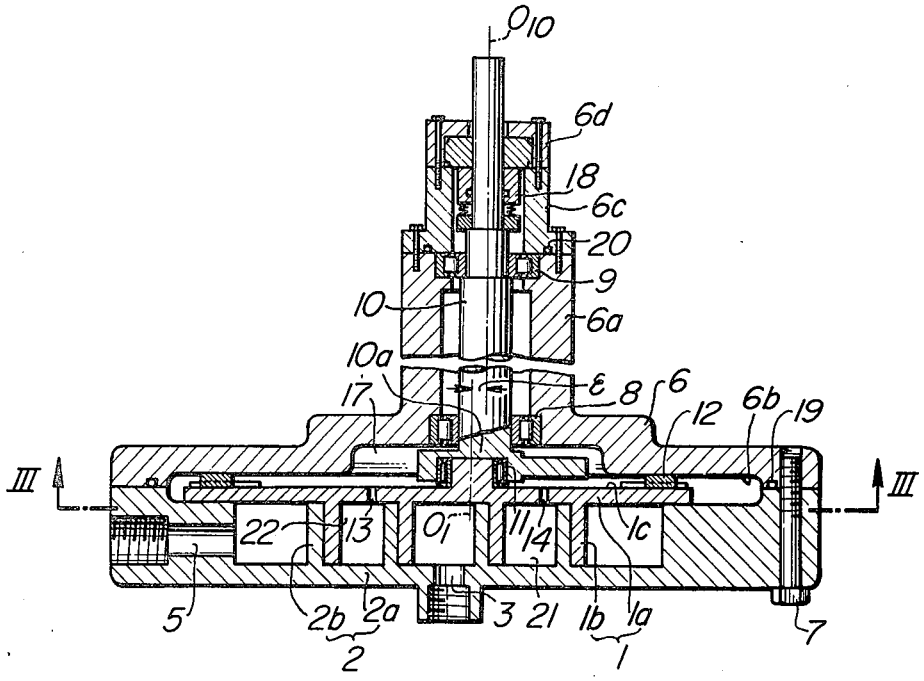
FIG. 2 is a vertical sectional view of the scroll fluid apparatus comprising one embodiment of the invention.
Figure 3:
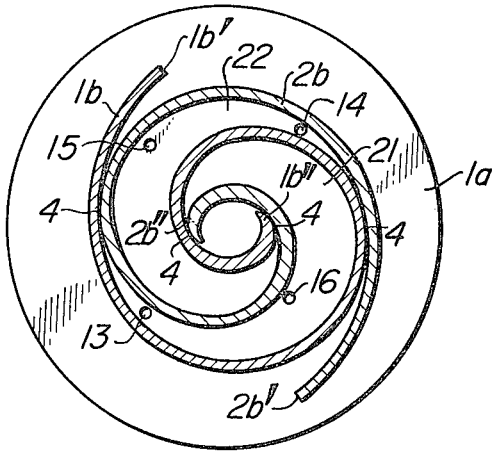
FIG. 3 is a sectional view taken along the line III—III in FIG. 2.

FIGS. 2 and 3 show one embodiment, in concrete form, of the present invention. FIG. 2 is a vertical sectional view of the scroll fluid apparatus, and FIG. 3 is a sectional view taken along the line III—III in FIG. 2. As shown, the stationary scroll member 2 includes an end plate 2*a* and a lap 2*b* extending from the end plate 2*a* and disposed in an upright position. The revolving scroll member 1, which is of similar construction, includes an end plate 1*a* and a wrap 1*b* extending from the end plate 1*a* and disposed in an upright position. The two wraps 1*b* and 2*b* are substantially equal to each other in thickness and height, and arranged in the form of an involute or other curve closely resembling it.

The stationary scroll member 2 is formed at its center with an outlet port 3 and at its edge with a suction port 5.

The fixed scroll member 2 and the revolving scroll member 1 are positioned against each other in such a manner that the wraps 2*b* and 1*b* face inwardly and terminating points 2*b*′ and 1*b*′ of the wraps 2*b* and 1*b*, respectively, are displaced by 180 degrees or disposed in diametrically opposed positions.

A housing 6 is connected to the stationary scroll member 2 by means of a plurality of bolts 7 disposed equiangularly relative to one another.

The housing 6 includes a cylindrical portion 6*a* mounting therein two bearings 8 and 9 located in vertically spaced relation for supporting a drive shaft 10 having an end portion 10*a* which is engaged by the revolving scroll member 1 through a needle bearing 11. The drive shaft 10 and the revolving scroll member 1 are located relative to each other such that the center of rotation $0_{10}$ of the former and the center $0_1$ of the latter are spaced from each other by a distance $\epsilon$. The distance $\epsilon$ is referred to as the radius of revolution.

Interposed between a back 1*c* of the revolving scroll member 1 and a wall surface 6*b* of the housing 6 is an Oldham's ring 12 which has the function of preventing the revolving scroll member 1 from revolving on its own axis or about its center $0_1$.

At least one small aperture 13 is formed in the end plate 1*a* of the revolving scroll member 1 along the lap 1*b*. In the embodiment shown and described, four (4) small apertures 13, 14, 15 and 16 are formed, but the invention is not limited to this spacific number of small apertures. The small apertures 13, 14, 15 and 16 perform the function of communicating the housing chamber 17 with operating chambers 21 and 22 in which compression of a fluid is in progress. A compressed gas of an intermediate pressure level between the suction pressure and the discharge pressure flows through the small apertures 13, 14, 15 and 16 into the housing chamber 17 to maintain the pressure within the housing chamber 17 at the intermediate pressure level. The size of the small apertures 13, 14, 15 and 16 is selected on the basis of the volume of the housing chamber 17 and the capacity of the scroll compressor.

A mechanical seal 18 is mounted in a portion of the housing 6 through which the drive shaft 10 extends. An O-ring 19 is mounted between the adjacent surfaces of the housing 6 an the stationary scroll member 2, and another O-ring 20 is mounted between components 6*a* and 6*c* of the housing 6, so as to provide an airtight seal to the housing chamber 17. The housing chamber 17 and the operating chambers 21 and 22 are sealed by the end plates 1*a* and 2*a* of the two scroll members 1 and 2 respectively which are maintained in contact with each other.

The operation of the scroll fluid apparatus constructed as aforementioned will now be described. Rotation is transmitted from a drive, such as an electric motor (not shown), to the drive shaft 10 whose rotation is transmitted, through the needle bearing 11, to the revolving scroll member 1 which moves in revolving movement of the radius of revolution of $\epsilon$ around the center $0_{10}$. While moving in revolving movement, the revolving scroll member 1 is prevented by the Oldham's ring 12 from revolving on its own axis. Thus the revolving scroll member 1 revolves around the center $0_{10}$ of the drive shaft 10, without changing its posture relative to the stationary scroll member 2.

With the revolving scroll member 1 revolving around the center $0_{10}$ of the drive shaft 10 as aforementioned, the lines of contact 4 between the revolving scroll member 1 and the stationary scroll member 2 move from the terminating points 1*b*′ and 2*b*′ of the wraps 1*b* and 2*b* respectively toward starting points 1*b*″ and 2*b*″ thereof, with the result that the operating chambers 21 and 22 defined by the end plates 1*a* and 2*a* and the wraps 1*b* and 2*b* of the revolving scroll member 1 and the stationary scroll member 2, respectively, grow smaller in volume and compression of the fluid is effected.

A compressed gas of the intermediate pressure level flows through the small apertures 13, 14, 15 and 16 to the housing chamber 17 from the operating chambers 21 and 22 while the gas is being compressed in these chambers, and the pressure within the housing chamber 17 is maintained at the intermediate pressure level. The gas of the intermedate pressure level within the housing chamber 17 forces the revolving scroll member 1 tightly against the stationary scroll member 2 to provide an axial seal to the two scroll members 1 and 2.

The advantages offered by the present invention can be summarized as follows. Since the gas of the intermediate pressure level acts on the revolving scroll member 1, no excessively high biasing force is exerted by the gas on the revolving scroll member even if the pressure of the gas is applied to the entire area of the back of the revolving scroll member 1. Thus a good axial seal can be provided to the revolving and stationary scroll members 1 and 2.

In refrigerant compessors or expansion devices, it is essential that the housing be constructed in such a manner as to avoid the leakage of a gas from the scroll fluid apparatus to the outside or invasion of the scroll fluid apparatus by a gas from the outside. This requirement is met by the present invention, since the invention enables a good axial seal to be provided to the two scroll members merely by forming at least one small aperture in the end plate 1*a*. In other words, the end of providing an axial seal can be attained by a very simple construction.

The gas compressed or expanded by the scroll fluid apparatus itself is used for providing an axial seal to the two scroll members, so that the need to use a separate pressure source outside the apparatus is eliminated. Additionally, there is no hazard of a dissimilar gas being incorporated in the gas handled by the scroll fluid appratus, and what is required is merely to prevent the leakage of the gas from the apparatus to the outside. With regard to the leakage of gas, prevention of gas leakage can be effected readily because the gas introduced into the housing chamber is at the intermediate pressure level.

What is claimed is:

1. A scroll fluid apparatus comprising:

scroll means including a revolving scroll member and a stationary scroll member, each of said revolving scroll member and said stationary scroll member having an end plate and a wrap extending from said end plate and disposed in an upright position;

drive shaft means mounted for rotation about its center axis which is eccentric with respect to the center of said revolving scroll member so as to cause the revolving scroll member to revolve around said drive shaft means;

housing means formed therein with a housing chamber;

an Oldham's ring for preventing the revolving scroll member from revolving about its center and causing the same to revolve around said drive shaft means without changing its posture;

a suction port; and an outlet port;

wherein the improvement comprises:

a mechanical seal mounted in a portion of said housing means through which said drive shaft means extends so as to provide a seal to said housing chamber; and at least one small aperture formed in the end plate of one of said two scroll members for communicating said housing chamber with operating chambers of the scroll fluid apparatus in the process of compressing or expanding a fluid so as to keep the internal pressure of said housing chamber at a pressure level which is intermediate between the pressure at which the fluid is sucked into said operating chambers and the pressure at which the fluid is discharged therefrom, so that the fluid at the intermediate pressure level can force one scroll member tightly against the other scroll member to provide an axial seal thereto.

2. A scroll fluid apparatus as claimed in claim 1, wherein said at least one small aperture for communicating said housing chamber with said operating chambers in the process of compressing or expanding a fluid is formed in the end plate of said revolving scroll member.

3. A scroll fluid apparatus as claimed in claim 1, wherein said at least one small aperture for communicating said housing chamber with said operating chambers in the process of compressing or expanding a fluid is formed along said wrap.

4. A scroll fluid apparatus as claimed in claim 2, wherein said at least one small aperture is two in number, and each of said operating chambers communicates with said housing chamber through one small aperture.

5. A scroll fluid apparatus comprising:

scroll means including a revolving scroll member and a stationary scroll member, each of said revolving scroll member and said stationary scroll member having an end plate and a wrap extending from said end plate and disposed in a upright position;

drive shaft means mounted for rotation about its center axis which is eccentric with respect to the center of said revolving scroll member so as to cause the revolving scroll member to revolve around said drive shaft means and to form a series of successive operating chambers between the two scroll members;

housing means for forming a housing chamber overlying the revolving scroll member;

a suction port; and an outlet port;

wherein the improvement comprises:

at least one small aperture formed in the end plate of one of said two scroll members for communicating said housing chamber with at least one of the operating chambers of the scroll fluid apparatus in the process of compressing or expanding a fluid so as to keep the internal pressure of said housing chamber at a pressure level which is intermediate between the pressure at which the fluid is sucked into said operating chambers and the pressure at which the fluid is discharged therefrom, so that the fluid at the intermediate pressure level can force one scroll member tightly against the other scroll member to provide an axial seal thereto, said at least one small aperture being positioned at a location where the intermediate pressure is substantially less than the discharged pressure at the outlet port.

6. A scroll fluid apparatus as claimed in claim 5, wherein at least two small apertures are provided in position so as to communicate said housing chamber to a pair of the operating chambers.

* * * * *

UNITED STATES PATENT AND TRADEMARK OFFICE

CERTIFICATE OF CORRECTION

PATENT NO. : 4,475,874

DATED : October 9, 1984

INVENTOR(S) : SATO

It is certified that error appears in the above-identified patent and that said Letters Patent is hereby corrected as shown below:

On the title page

[30] Foreign Application Priority Data
Mar. 28, 1977 [JP] Japan.....52-33397

Signed and Sealed this

*Twenty-fourth* Day of *December 1985*

[SEAL]

*Attest:*

DONALD J. QUIGG

*Attesting Officer*

*Commissioner of Patents and Trademarks*